US011912476B2

(12) United States Patent
Angelozzi et al.

(10) Patent No.: US 11,912,476 B2
(45) Date of Patent: Feb. 27, 2024

(54) LIGHTWEIGHT, CHILD RESISTANT CLOSURE WITH TAMPER EVIDENT, COMBUS-TION RESISTANT, AND/OR STRIP-TORQUE RESISTANT FEATURES

(71) Applicant: RIEKE LLC, Auburn, IN (US)

(72) Inventors: Anthony M. Angelozzi, Fort Wayne, MI (US); Gary M. Baughman, Fort Wayne, IN (US); Dale W. Taylor, Hamilton, IN (US); Thomas P. Kasting, Fort Wayne, IN (US)

(73) Assignee: RIEKE LLC, Auburn, IN (US)

( * ) Notice: Subject to any disclaimer, the term of this patent is extended or adjusted under 35 U.S.C. 154(b) by 295 days.

(21) Appl. No.: 17/297,538

(22) PCT Filed: Nov. 27, 2019

(86) PCT No.: PCT/US2019/063493

§ 371 (c)(1),
(2) Date: May 27, 2021

(87) PCT Pub. No.: WO2020/112927

PCT Pub. Date: Jun. 4, 2020

(65) Prior Publication Data

US 2021/0394978 A1 Dec. 23, 2021

Related U.S. Application Data

(60) Provisional application No. 62/771,689, filed on Nov. 27, 2018.

(51) Int. Cl.
*B65D 50/04* (2006.01)
*B65D 51/16* (2006.01)

(52) U.S. Cl.
CPC ..... *B65D 50/041* (2013.01); *B65D 51/1633* (2013.01); *B65D 2215/00* (2013.01)

(58) Field of Classification Search
CPC ..... B65D 50/041; B65D 2205/00; B65D 2215/02; B65D 2215/00
See application file for complete search history.

(56) References Cited

U.S. PATENT DOCUMENTS 3,692,199 A 9/1972 Mumford
3,756,444 A 9/1973 McIntosh
(Continued)

FOREIGN PATENT DOCUMENTS

EP 0030830 A1 6/1981

OTHER PUBLICATIONS

Extended European Search Report dated Jul. 15, 2022; European Patent Application No. 19889242.4 filed on Jun. 16, 2021.
(Continued)

*Primary Examiner* — Shawn M Braden
(74) *Attorney, Agent, or Firm* — McDonald Hopkins LLC

(57) ABSTRACT

A child-resistant closure having inner and outer caps cooperating as a nested shell is contemplated. Downward force applied to the closure engages a series of cooperating lugs and detents to engage the child resistant feature, while thinned walls and cooperating, ramped skirts on the shells' interfacing surfaces to improve the hoop strength along a predefined circumference to avoid stripping/disengagement of the threads on the closure and container neck. An optional tamper evident ring may also be provided, as well as a combustion resistant vent formed in the top panel of the inner shell.

21 Claims, 8 Drawing Sheets

(56) References Cited

U.S. PATENT DOCUMENTS

| | | | | |
|---|---|---|---|---|
| 4,053,077 | A | 10/1977 | Defelice | |
| 4,480,759 | A | 11/1984 | Behrens et al. | |
| 4,799,598 | A | 1/1989 | McFadyen | |
| 4,854,459 | A | 8/1989 | DeJonge | |
| 6,206,216 | B1 | 3/2001 | Stalions | |
| 8,316,622 | B2 | 11/2012 | Jajoo | |
| 8,474,634 | B1 * | 7/2013 | Branson | B65D 50/041 215/230 |
| 2004/0155040 | A1 | 8/2004 | Stolzenfeld | |
| 2005/0161425 | A1 | 7/2005 | Morini | |
| 2007/0017891 | A1 * | 1/2007 | Herr | B65D 55/022 215/349 |
| 2014/0014611 | A1 | 1/2014 | Buehler et al. | |
| 2019/0344938 | A1 * | 11/2019 | Lebon | B65D 41/0414 |

OTHER PUBLICATIONS

Patent Cooperation Treaty (PCT), International Search Report and Written Opinion for Application PCT/US2019/63493 filed Nov. 27, 2019, dated Jan. 22, 2020, International Searching Authority, US.

* cited by examiner

LIGHTWEIGHT, CHILD RESISTANT CLOSURE WITH TAMPER EVIDENT, COMBUS-TION RESISTANT, AND/OR STRIP-TORQUE RESISTANT FEATURES

CROSS-REFERENCE TO RELATED APPLICATIONS

This application claims priority to U.S. Provisional Patent Application Ser. No. 62/771,689, filed on Nov. 27, 2018, which is incorporated by reference herein.

TECHNICAL FIELD

The present invention relates to a child resistant closure and, more particularly, to such a closure formed as a cap having improved hoop strength within its skirt to avoid strip torque conditions and to provide consistent performance on drop testing. Optional tamper evident and/or combustion resistant vent features are contemplated.

BACKGROUND

Child resistant (CR) screw top caps are well known. One particular style includes the use of an inner cap nested within an outer cap. Along the interface between these inner and outer shells, cooperating features can be urged together by application of sufficient force to engage the features and permit rotation of the entire assembly to remove/connect the container. The dexterity and strength required to urge the shells together is beyond the capabilities of most young children, thereby imparting a child resistant feature to the closure system.

U.S. Pat. Nos. 3,692,199; 4,053,077; 4,480,759; 6,206,216; and 8,316,622 provide examples of some of these prior art designs. One notable commonality in these designs is that the inner and outer shells must possess sufficient structural integrity to withstand the forces inherent to operation of these designs. In particular, these forces are applied in the downward or axial direction by the user, to engage child resistant formations along the top planar interface between the inner and outer shells. Additional force is encountered along the inward or radial direction both during manufacture, so as to snap-fittingly receive the inner shell within the outer shell, and by the user in operating the closure system. In particular, the sidewalls of each shell must be of sufficient thickness to prevent the inner shell from flexing or becoming dislodged from the screw threads as pressure is applied to secure the cap it to the container, while simultaneously being durable enough to withstand the axial and radial forces applied to it to engage the CR functionalities along the sidewalls or peripheral interface(s) of the shells.

FIG. 1 is a schematic, cross sectional view illustrating the basic functionality of these designs. Container neck 5 is screw fitted onto closure 10. Closure 10 includes an outer shell 20 having a cylindrical sidewall or skirt 22 projecting axially down from a top panel 24. A circumferential flange 23 extends radially inward at the bottom edge of the skirt to ensure the inner shell 30 cannot become dislodged from the closure 10. Otherwise, sidewall 22 retains a similar thickness between most, if not all, of its length between it junction with panel 24 and flange 23. Along the inner facing of the top panel 24, CR lugs 26 project downward at intermittent intervals. The lugs 26 may have uniform, radially aligned ramping sections to allow slidable rotation of the outer shell 20 over the inner shell 30 in one direction (i.e., clockwise or counterclockwise) to avoid engaging the CR lugs 26.

Inner shell 30 rests within the outer shell 20. Engagement features 33, such as cooperating bores and/or threads, are formed along the inner circumference of sidewall or skirt 32 and cooperate with corresponding features 3 found on the outer diameter of the container neck 5.

In some embodiments, inner shell 30 may include a terminal outwardly extending, radial flange or flare 35 to engage flange 23 and retain the nested arrangement of shells 20, 30. Flange 35 may be tapered or ramped on its outer circumference to impart a frustoconical shape to the cylinder defined by shell 20, as well as to allow for inner shell 20 to be snap-fitted into the outer shell 30.

Shell 30 has a top panel 34 spanning the upper edges of skirt 32. CR detents 36 which cooperate with CR lugs 36 formed in the respective top panels 24, 34, provided these features are arrayed in a similar manner on the panels 24, 34. It is also possible for CR lugs 26 and CR detents 36 to be formed together on the same panel.

Hinges and/or biasing members (not shown) may be employed at the interface between the outer and inner shells 20, 30. In this manner, the lugs 26 can be urged away from detents 36 to ensure the closure 10 is predisposed toward its child resistant functionality.

Skirt 32 must be of sufficient, independent strength to prevent the engagement features 33 from "popping out," "jumping tracks," or otherwise being temporarily pushed out and stripped away from features 3, particularly during opening and closing. Normally, this requires using extra thick materials which will result in higher production costs. If such "strip torque" conditions occur, a user may struggle to open or close the container without undue effort owing to his/her inability to rotatably slide the closure up or down the container neck. Thus, these style of CR caps usually require increased thickness along the skirts 22, 32, which leads to higher materials' cost, weight, etc.

Another issue is that the spacing of the CR features do not necessarily accommodate other features. For example, some closures may seal containers carrying combustible, pressurized or other materials requiring a tight seal between the edge of the container neck 5 and the inner facing of the inner shell 30 (i.e., along the underside of the top panel 34 and/or along its junction with the skirt 32). Further, because of the CR features 26, 36 are positioned on the interface of panels 24, 34, the panels 24, 34 are typically provided with enhanced strength so as to sustain the force required to engage features 26, 36. The structural strength of panels 24, 34 can allow and cause dangerous pressure buildup if unwanted pressure builds within the container (e.g., flammable or highly volatile fluids in the container are exposed to heat or flames). Eventually, that pressure will release, sometimes explosively, by rapid and unintentional disassembly of the closure or, worse, disintegration of the entire container.

A CR closure that addresses these shortcomings would be welcome. Further, a multi-piece design made entirely from easily manufactured and/or recyclable plastic components would be helpful.

SUMMARY

A closure having inner and outer caps cooperating as a nested shell is contemplated. Downward force applied to the closure engages a series of cooperating, lugs and detents on the inner and outer shells to selectively engage the child resistant feature. Separately, thinned walls and cooperating, ramped skirts on the shells' interfacing surfaces to improve the hoop strength along the pertinent circumference of the closure's skirt in order to avoid stripping or disengagement of the bores/threads on the closure and container neck. Further, a tamper evident ring with frangible or otherwise separable attachments may also be provided. Lastly, a plug seal and/or combustion resistant vent may be formed in the top panel of the inner shell to allow for desired sealing and the release of unwanted pressure build up inside of the sealed container.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIGS. 3B and 3C are viewed along the axis defined by line 3-3 in FIG. 3A.

FIG. 4A is an exploded perspective view of a second aspect of the child resistant, combustion resistant venting cap assembly as disclosed herein, while

FIG. 5A is a cross sectional side view of the embodiment shown in FIG. 4A, while

DETAILED DESCRIPTION

Figure 1:
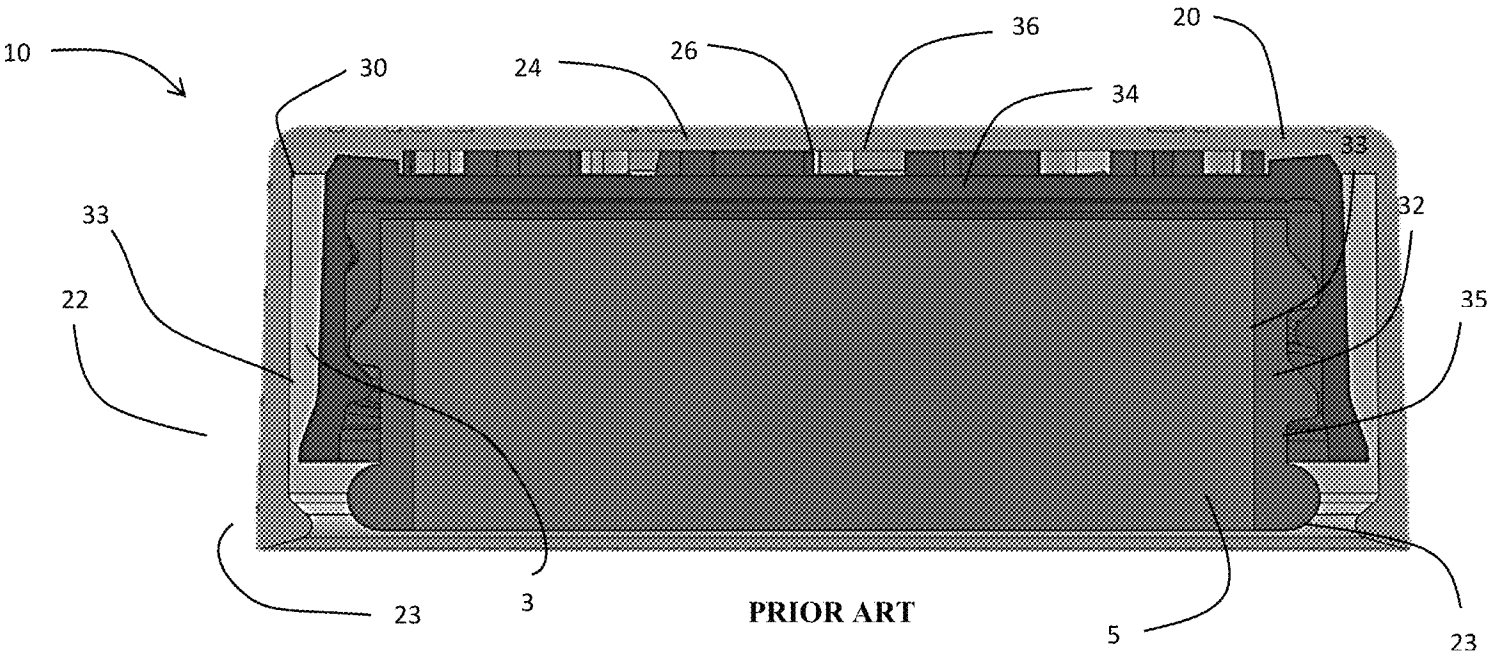
PRIOR ART FIGURE 1
FIG. 1 is a cross sectional side plan view of a conventional child resistant cap assembly, in an engaged position (i.e., with downward axial force being applied), according to the prior art.

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

With reference to the child resistant features of all aspects of the cap and closure systems contemplated herein, closure 100 is screw-fitted onto container neck 50. While neck 5 is shown as having threads 3 which engage corresponding threads on the closure 100, it is understood that other engagement arrangements may be possible. Notably, container neck 5 includes a flange or finishing feature 4 at the terminal top end where it engages the closure 100 and, more specifically, an inner facing of inner shell 300.

As above, closure 100 includes a cup-shaped outer shell 200 having a second, cooperatingly cup shaped inner shell 300 nested therein. The shells 200, 300 may be made from any workable plastic, with injection or other moldable materials being particularly useful owing to their costs and ease of manufacture. Nevertheless, any of the discrete components or portions thereof may be formed from other compatible materials, such as elastomers, thermosets, rubbers, membrane-like materials and the like.

Outer shell 200 may include knurling or other grip-improving features 224 (e.g., ribs, stipling, ridges, thumb grips, etc.) are formed on the sidewalls 220 along sidewalls/skirt 220. Features 224 may also be formed to allow for selective reinforcement and strengthening of the skirt 220 while minimizing the amount of material required by bridging other reinforced and/or load-bearing structures such as top panel 240 and lower band 222. Band 222 is a thickened, reinforcing ring positioned at the terminal bottom edge of the skirt 220. The reduction in diameter, at least along the inner facing of the shell 200, as the band 222 transitions to the sidewall 220 coincides with the retention features 230 described below Instructions and/or other printed or embedded indicia may be provided along the outer surface(s) of shell 200. For example, top panel 240 may include printed indicia on its outer facing surface 244.

Sidewall 220 extends axially downward from the top panel 240, usually as circular cylinder attached/formed integrally at or near the outer periphery of panel 240. Preferably, the sidewall 220 is vertical or angled acutely relative to the vertical, with the orientation ultimately determined by its fitting with the inner shell 300 and the shape of the container neck 50 itself.

A continuous or intermittent circumferential band of increased thickness 222 is provided at or near the bottom end of sidewall 220. This band 222 accommodates a shell-retention feature 230, such as a circumferential groove 231. Groove 231 cooperates with a corresponding engagement feature 330 on the inner shell 300 and may be formed as a continuous or series of intermittently spaced apart channels which receive a protruding edge 351 on the shell 300. Thus, the inner diameter of groove 231 is larger than the outer diameter of edge 351. Further, an annular flange or catchment 232 extends radially inward from the inner facing of skirt 220/band 222 to define the bottom edge of the groove 231. Catchment 232 may curl or angle upward towards panel 240, and it may be formed as a distinct, continuous or intermittent flange projecting radially inward.

At the upper facing of the groove 231, a sloped ramp 234 transitions back to the inner diameter of the skirt 220 above the band 222. Thus, upper edge of feature 230 is a more gently sloping and/or tapered ramp 234. At its top edge, ramp 234 has an inner diameter that is similar to that of flange 231, so as to create upper and lower boundaries into which engagement feature 330 is restrained.

Owing to the increased thickness of band 222, feature(s) 230 may be machined or formed into the shell 200. Alternatively, the shell can be integrally formed or molded to have such features 230. The band 222 also provides a region of increased hoop strength.

As above, CR features 260 such as lugs and/or detents are formed on the inner facing 242 of panel 240. These features 260 may be arranged in circular and spaced apart fashion near the periphery of the panel 240, although these features 260 could be provided in a more centralized region (particularly in designs where child resistance and/or plug sealing was prioritized over venting). The features 260 may also include biasing members so as to create separation 265 between the inner shell 300 and outer shell 200 along their underside interface of top panel 240. Ratchet teeth having stops and ramps 262 cooperate with corresponding features 360 (e.g., ribs, cooperating ramps or teeth, etc.) on outer top of shell 300 to facilitate engagement and rotation of the closure 100 in a preferred direction (e.g., closing rotation or opening rotation).

Outer shell 200 has a main body defined by the top panel 240 and skirt 220, immediately where the junction of these elements meet. The outer diameter of this main body is smaller than the outer diameter of band 222. The transition 212 between these outer diameters (main body 220, 240 to band 222) occurs as step, gradual taper, or ramped section along its exterior, while the corresponding inner facing at the transition 212 includes inner ramp 234. Ramp 234 restrains ramped, continuous or intermittent flange or protrusion 351 formed on an outer circumference of skirt 320.

Inner shell 300 includes top panel 340 onto which CR features 360 are formed on its top side, facing CR features 260. Skirt 320 extends downward from panel 340, and threads 323 or other engagement features provided on the inner facing of the shell 300 to engage the container neck 5 and/or its peripheral finish 4.

Notably, the outer diameter of panel 340 and skirt 320 at their top juncture is smaller than the corresponding inner diameter of panel 240 and skirt 220. Similarly, the outer diameter of skirt 320 is less than the inner diameter of skirt 220 excepting for engagement feature 330. An amount of axial movement, indicated by element 265 is afforded between shells 200, 300, so as to allow for selective engagement of the CR features 260, 360 by applying downward axial force on the outer shell 200.

As that downward force is applied to engage CR features 260 and 360, ramp 234 and protrusion 331 are urged into contact along their entire collective circumference. In turn, this combination and contact creates a region of increased hoop strength that prevent flexing or deflection of skirt 320. In this manner, strip torque conditions are avoided, and the closure 100 can be rotated without the threads of the closure 100 popping or jumping off those on the neck 50.

Additionally, the existence of and reliance upon band 222 enables the use and reliance upon thinner wall sections in the main body portion of skirt 220, as well as skirt 320. In this manner, a reduction in material can be realized in the closure 100, particularly in comparison to earlier designs in which the strength of the inner cap 30 dictated the ability to avoid strip torque. Nevertheless, anti-crush ribs 226 may be provided in a continuous or spaced apart arrangement on the inner facing of shell 200. Ribs 226 cooperate with a shoulder 326 formed in the skirt 320 of the inner shell 300. In this manner, the closure 100 can be imparted with additional strength to withstand impact forces applied in the axial direction (e.g., if the closure and container were inverted and dropped, if an object was forced down upon the container, etc.). Notably, container neck 5 also includes a cooperating support ledge or shoulder 6 to engage shoulder 326, which in turn engages rib 226.

As implied above, inner shell 300 nests and remains captured within the outer shell 300. A cylindrical sidewall or skirt 320 extends axially downward from a peripheral edge of top panel 340. CR lugs and/or detents 360 are formed on an outer facing 344 of the panel 340 in the same manner as features 260 of the outer shell 200, so as to allow for engagement and rotation of the shells 200, 300 as a single unit when sufficient downward force is applied on the closure 100.

Container-engagement features 323 are formed on the inner facing of the shell 300 and, more specifically, on the skirt 320. Features 323 may be grooves, although threads, tabs, or spiraling ribs are more preferably formed on the sidewall 320 so as to minimize its thickness (and, by extension, the amount of material required during manufacture). Threads 330 fit within/between corresponding features 30 formed on the container neck.

As noted above, at the terminal end of sidewall 320, a retention feature 330, such as ramped or flared flange 331, is formed continuously or intermittently around the circumference of the sidewall 320. When downward force is applied to closure 100 (so as to engage CR features 260, 360 and allow for rotation of the shells 200, 300, as seen in FIG. 3C), feature 330 is urged into contact with ramp 234. This interference fit creates increased hoop strength all along the plane of contact indicated region 332. Thus, the combined strength of sidewalls 220 and 320 are exerted in resistance to any possible strip torque created by the action (or improper engagement of) threads 3, 323.

Feature 330 also acts to prevent dislodgement of the shell 300 out of its nested position within shell 200. As such, the outer diameter defined at the widest point across skirt 320 and flange 331 is larger than the inner diameter defined by the opposing edges flange 232. However, particularly when coupled with a venting mechanism as described below, the flexibility of the material used in forming skirt 320 and feature 330 can allow for the separation of shell 200 from shell 300 in certain scenarios. That is, shell retention feature 230 may have a rounded edge to allow protrusion 351 to slide over the flange/catchment 232. In other embodiments, feature 330 may be a series of discrete ribs or ramps projecting radially outward from the outer surface of skirt 320 along its bottom-most edge, rather than a continuous, circumferential flange 331. Notably, the axial height of movement indicated by region 332 is equal to or greater than the axial height of separation 265 required to disengage the CR features 260, 360.

Figure 2:
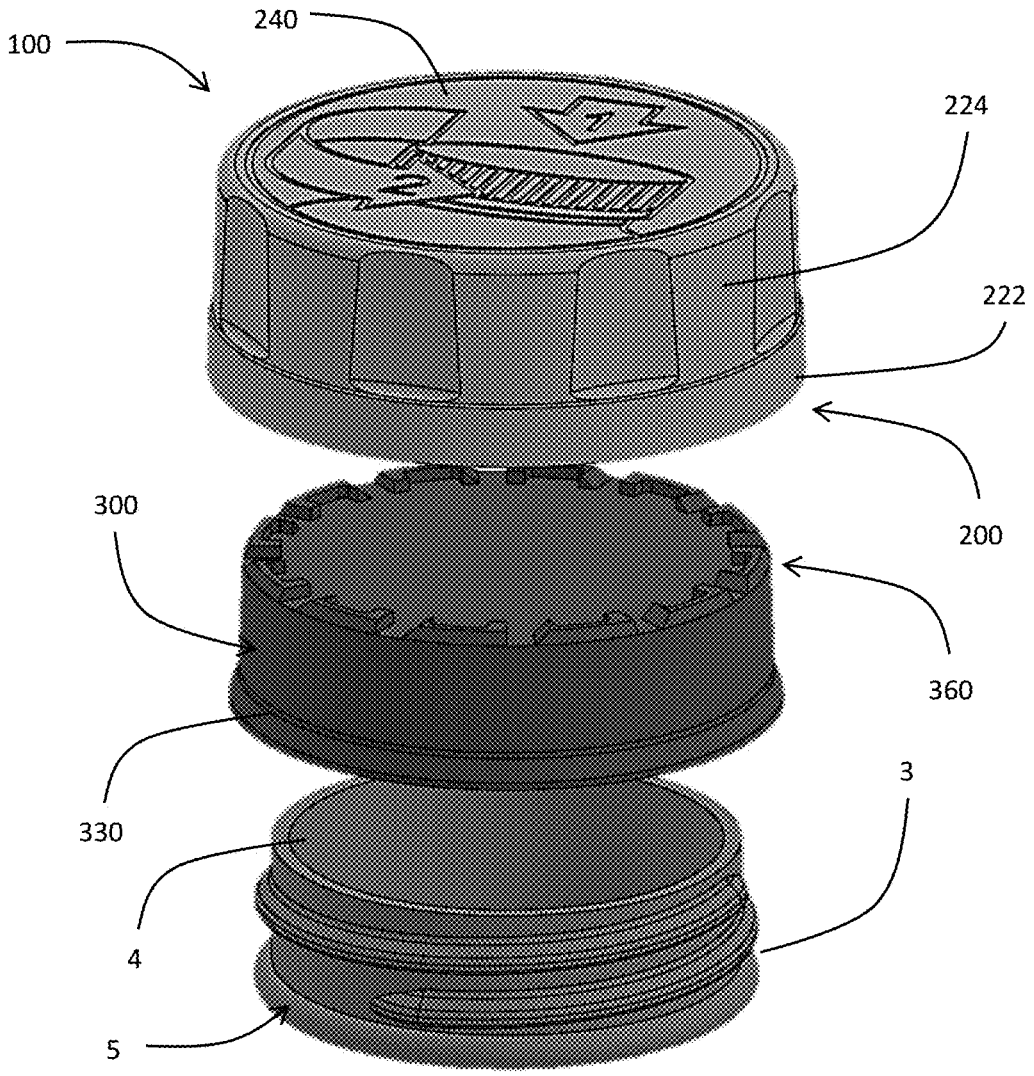
FIG. 2 is an exploded perspective view of one aspect of the child resistant, strip torque resistant cap assembly as disclosed herein. A sectional portion of the container neck is provided for further context.
Figure 3A:
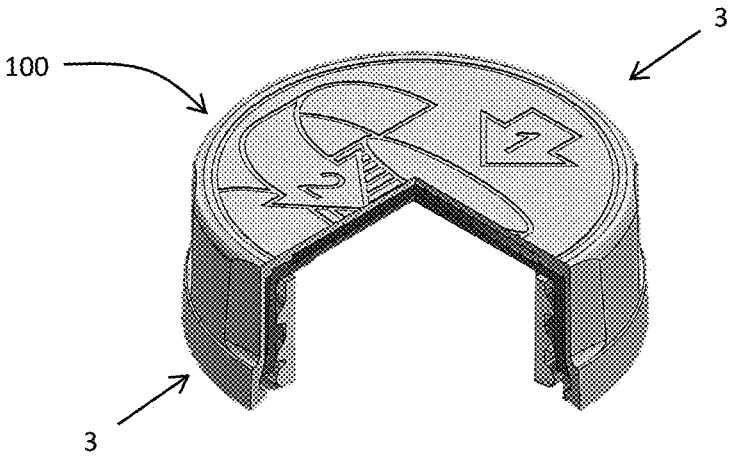
FIG. 3A is a perspective sectional cutaway view of the aspect illustrated in FIG. 2, with the cap assembly affixed to the container neck.
Figure 3B:
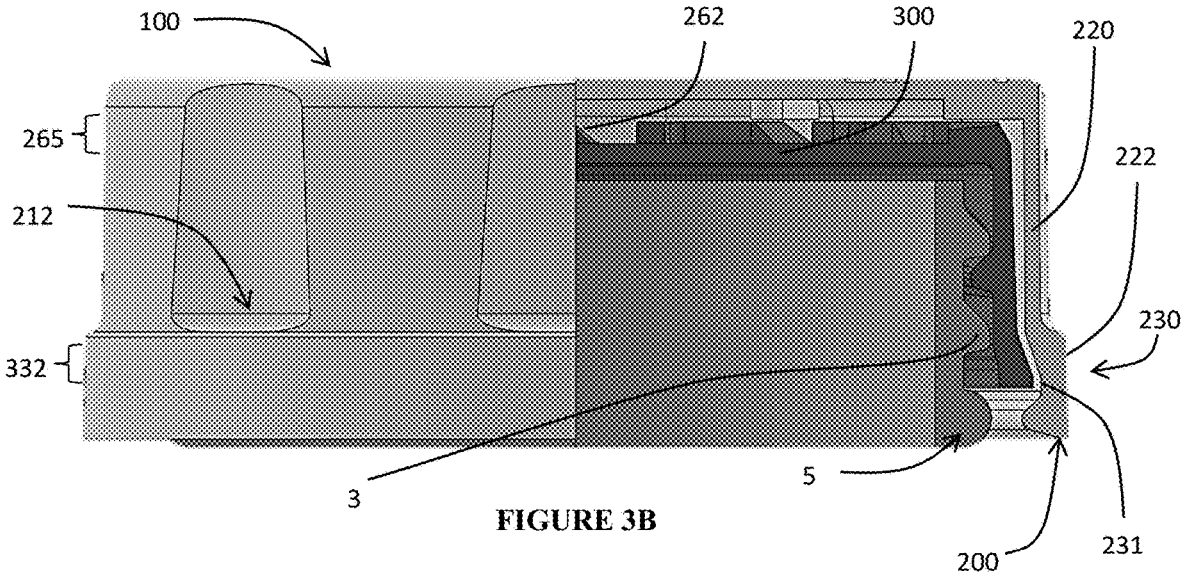
FIG. 3B is a side view of the aspect illustrated in FIG. 3A so as to show a portion of the cross sectional view, wherein the child resistant lugs are not engaged (i.e., the inner and outer shells are spaced apart).
Figure 3C:
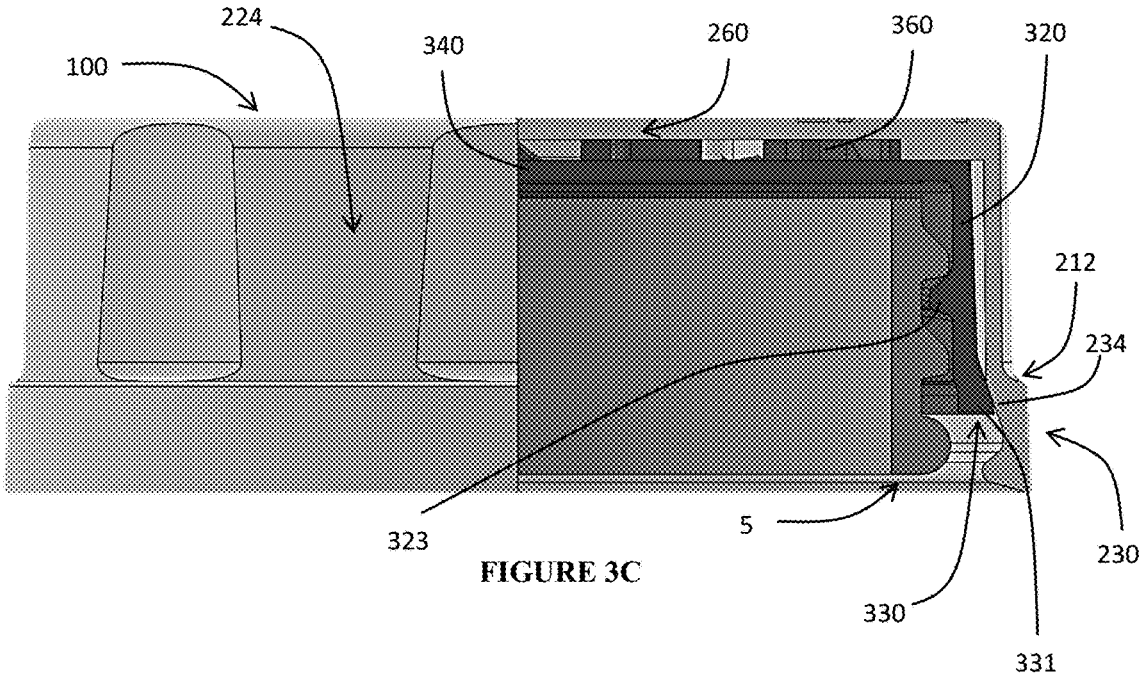
FIG. 3C is a side view of the aspect illustrated in FIG. 3A again showing a portion of the cross sectional view, wherein the child resistant lugs and the strip torque feature are both engaged. Both

As seen in FIGS. 4A through 7, additional features may be provided to closure 100 (unless noted herein, all of the aforementioned features of FIGS. 2 through 3C are present and used in these drawings) to further enhance functionality. To that end, child resistant features 260, 360 could be removed or treated as optional, particularly with respect to the vent and plug seal aspects.

Figure 4A:
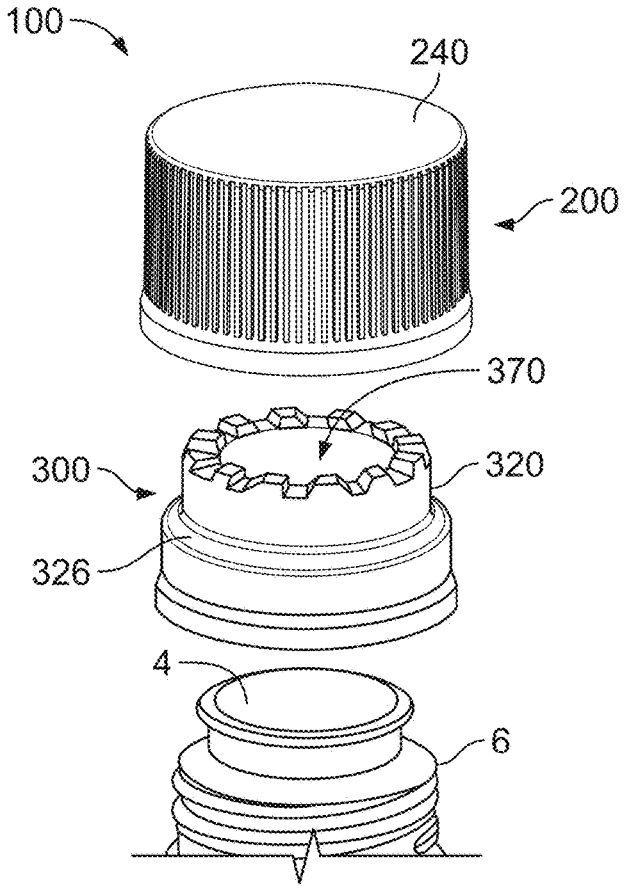
Figure 4B:
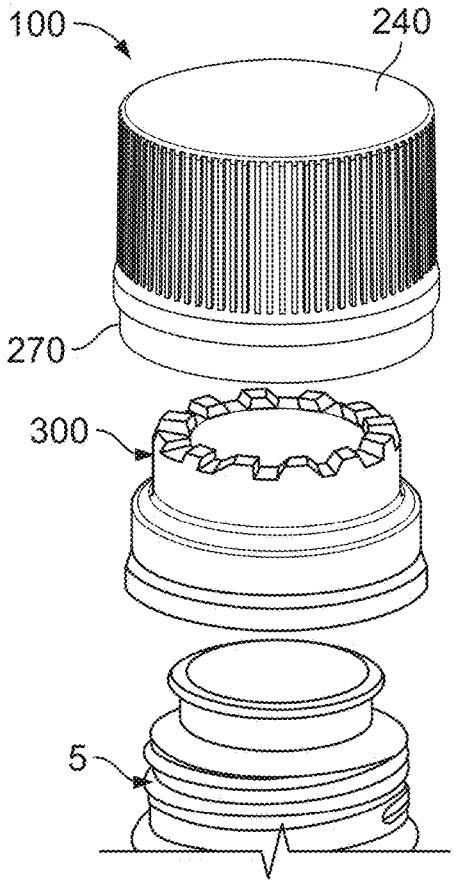
FIG. 4B is an exploded perspective view of the second aspect shown in FIG. 4A with a tamper evident feature included thereon (this tamper evident feature can also be incorporated with the first aspect shown in FIGS. 3A through 3C). Both views include a sectional portion of the container neck that doesn't necessarily form a part of the aspect itself.
Figure 4C:
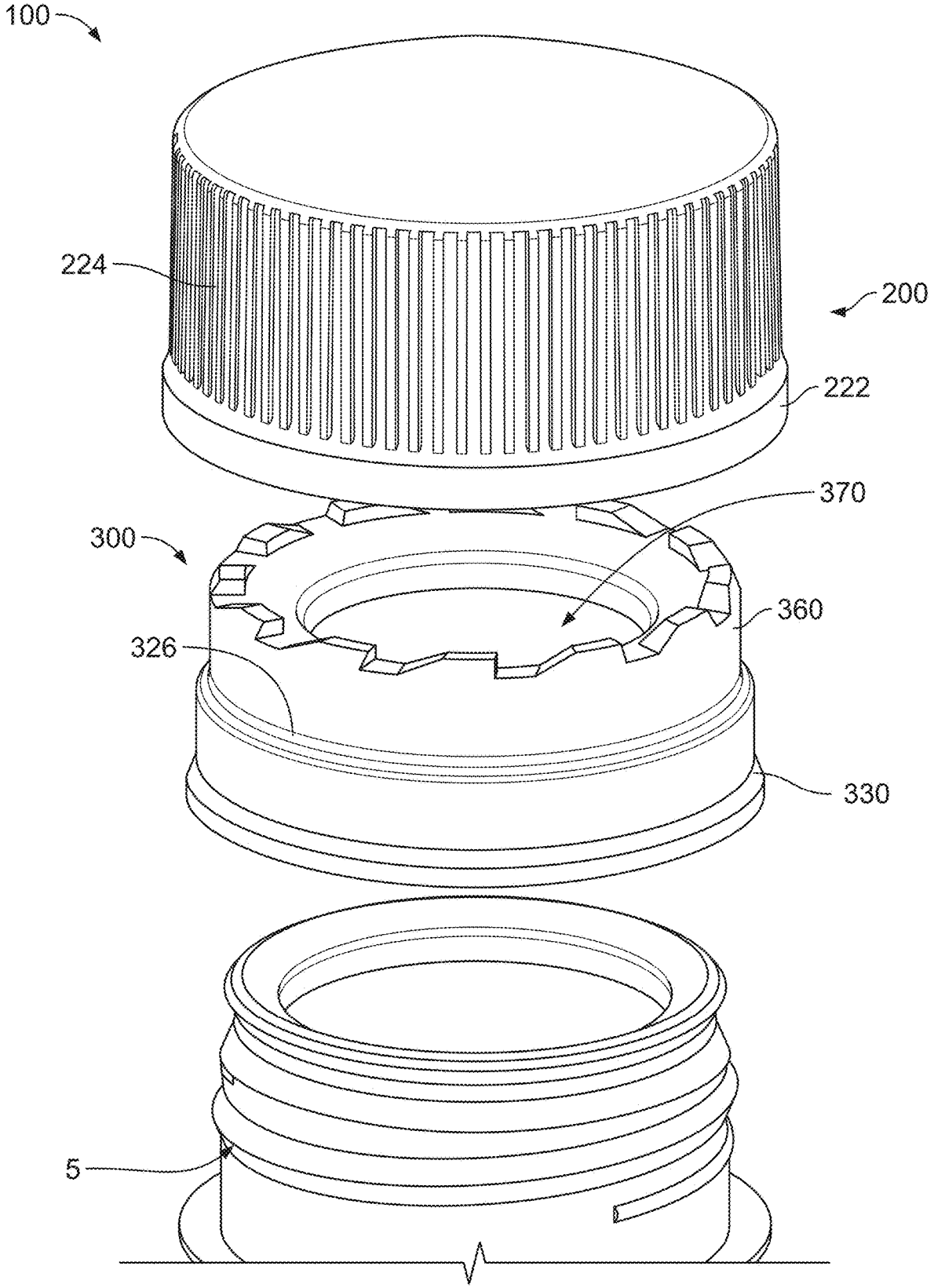
FIG. 4C is an exploded perspective view of a third aspect of the child resistant, combustion resistant venting cap in which the aspect ratio and positioning of the sidewall components of the inner cap have been adjusted so as to accommodate different container neck finishes.
Figure 5A:
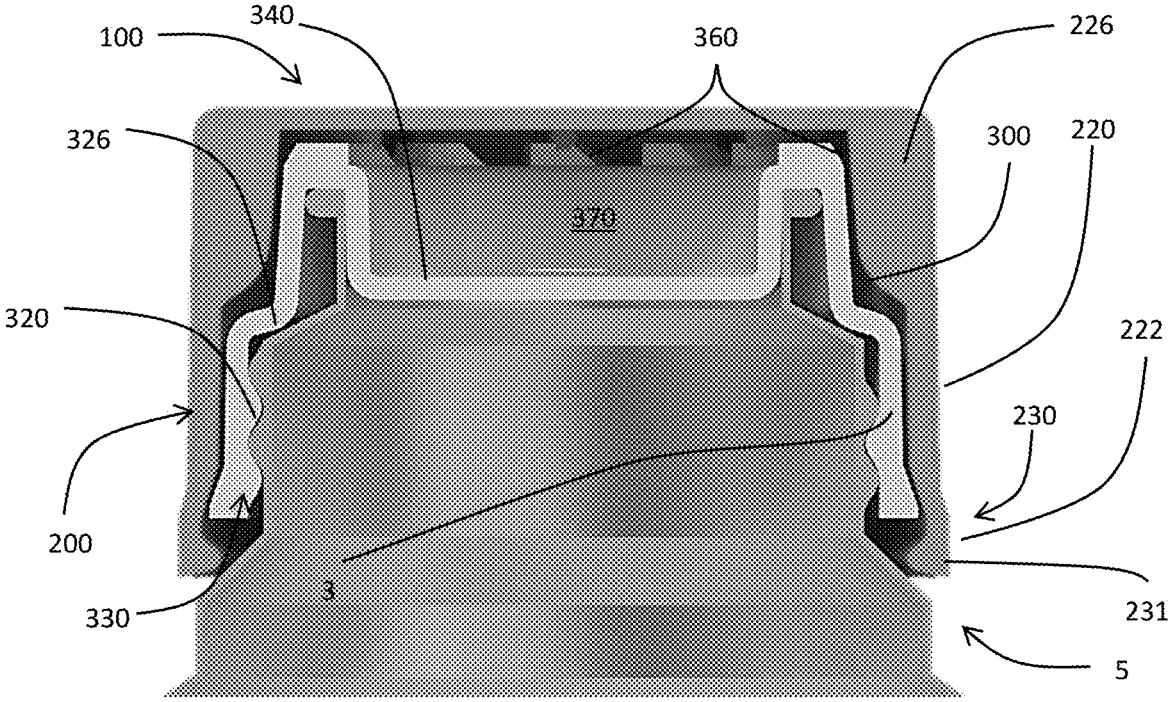
Figure 5B:
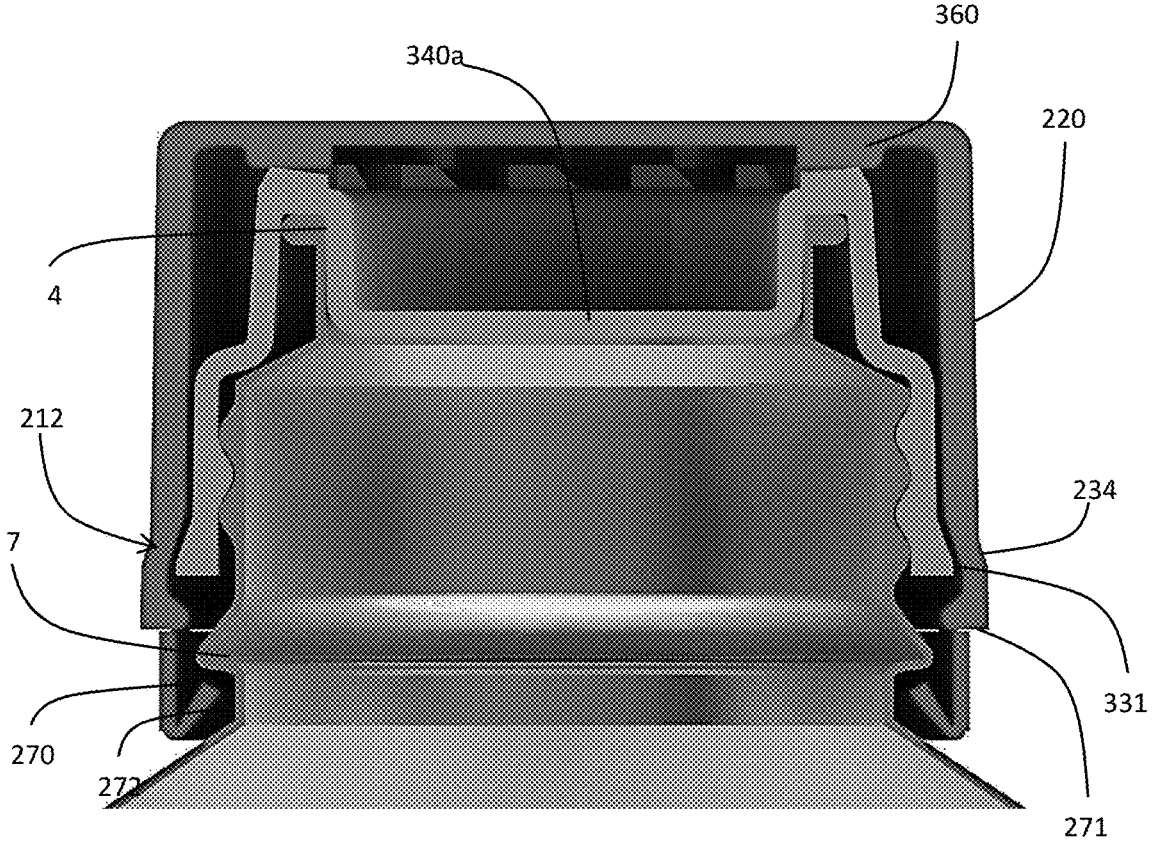
FIG. 5B is a cross sectional side view of the embodiment shown in FIG. 4B.
Figure 6A:
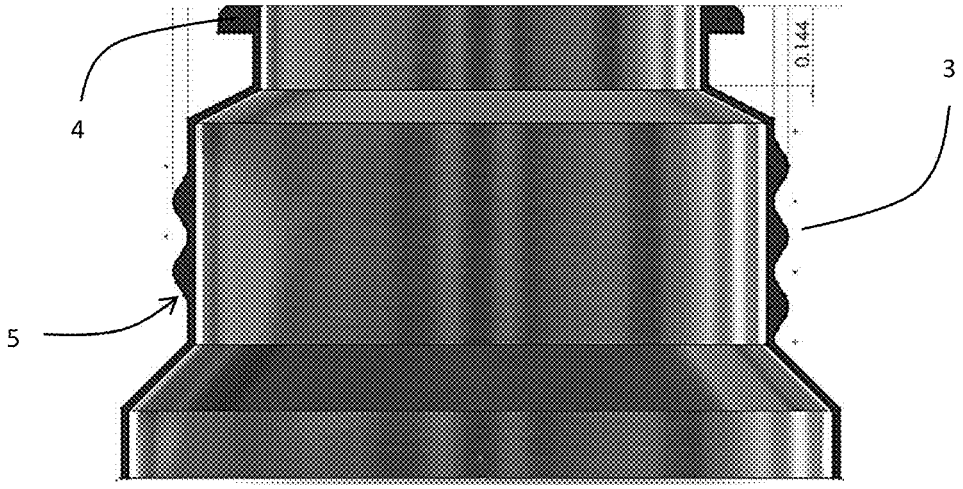
FIGS. 6A and 6B are cross sectional side views of container neck finishes appropriate for use with the plug seal aspects of the invention described herein.
Figure 6B:
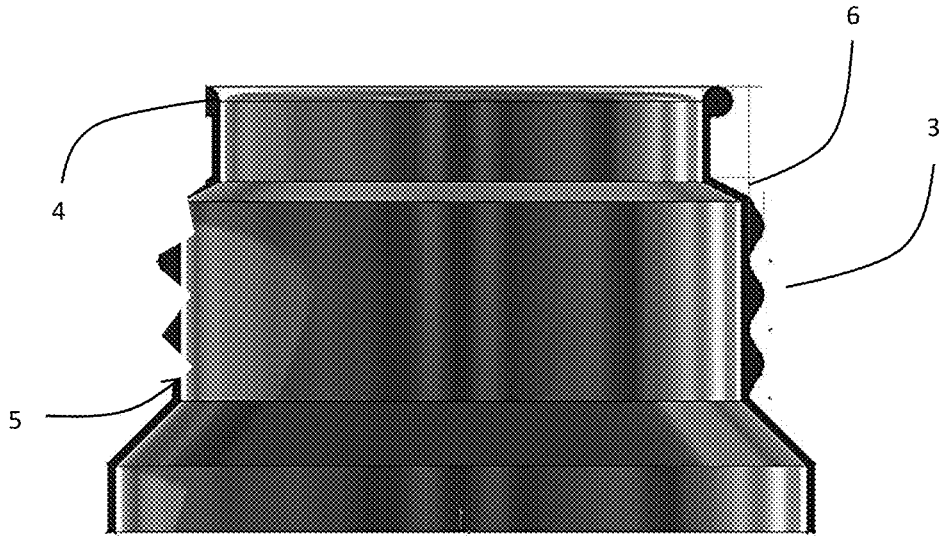
Figure 7:
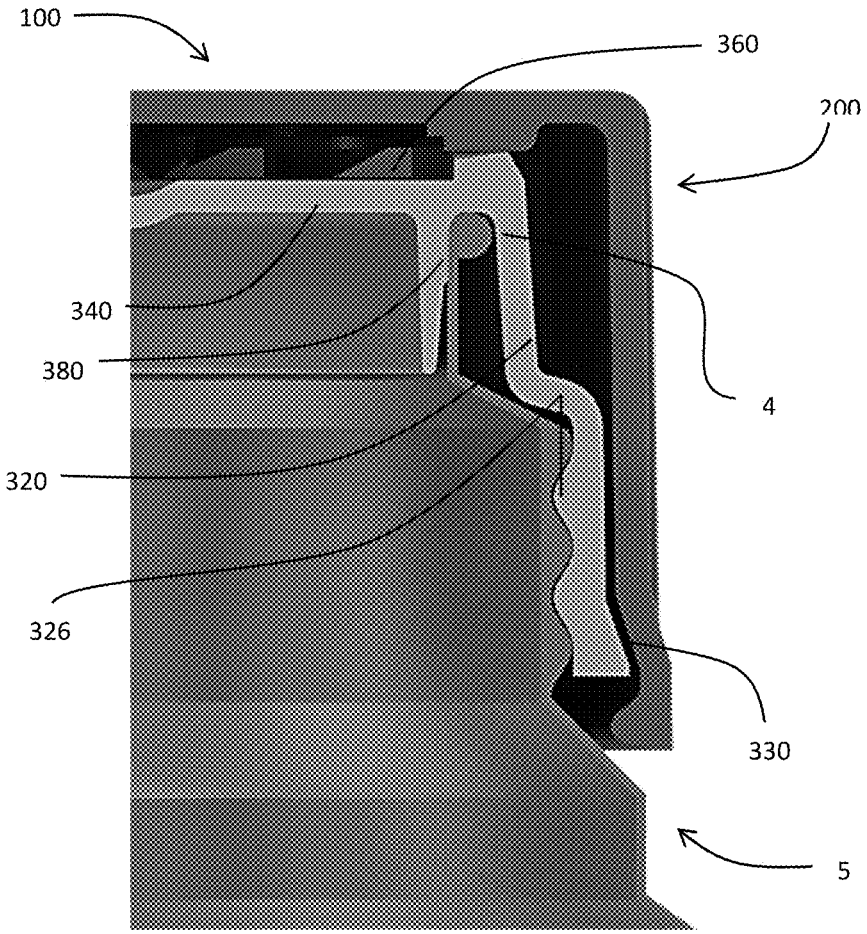
FIG. 7 is a partial cross sectional side view of a fourth aspect of the child resistant cap having a plug seal for engagement with the container neck finish.

As seen in the exploded views of FIGS. 4A through 4C, CR features 360 may include supporting, offset ribs or castellations may be formed on the top panel 340 for the additional purpose of axial strength. Gaps may be preserved between a selected number of castellations to allow for potential gaseous flowpaths, as will be described in greater detail below. Notably, these features 360 are still be formed similarly to—and provide the same functionality as—CR lugs and detents as described above.

More significantly, top panel 340, particularly along its center-most inset 340*a* (in a plane that is preferably free from CR features 360), is formed from a fusing material, such as nylon 6/6 and/or nylon polyamide 6. As used herein, the fusing material will be compromised when it is exposed to sufficient heat or pressure. That is, the fusing material will soften and separate under such conditions. In this manner, a vent path is created at inset 340*a* so as to avoid the dangerous buildup of gas and pressure within the container. As noted above, this gas is either released through the gaps in the castellations and then down between the space between skirts 220, 320 and out into the atmosphere. Additionally or alternatively, gas escaping from the vent created by the rupture of panel 340 can trigger the controlled release of shell 200 from shell 300 so as to allow for a more immediate flowpath. In this manner, the risk of combustion of fluids, as well as possible explosions caused by pressure buildup, can be minimized or avoided altogether.

In this aspect, panel 340 may include an indented or a cross sectional U-shape as it spans the space 370 between sidewalls 320, thereby partially extending down into the opening of container neck 5. This arrangement provides sufficient space/clearance between panels 240, 340 in the event the fusing material is forcibly burst and expelled upward. Further, it may ensure that the fusing material does not adhere to or otherwise create an obstruction closing off any of the potential flowpaths identified above.

Another feature highlighted relates to tamper evident (TE) feature 270. Feature 270 is formed as a ring or annulus that is detachable held to the bottom of skirt 320, preferably by way of a plurality of frangible bridge elements 271 which separate when indent portion 272 catches on neck feature 7 as the cap is initially removed (notably, the sloping nature of portion 272 allows to slide into a snap-fitting relationship without comprising elements 271). Perforations or other known detachable features can also be used so as to integrate feature 270 as an extension of skirt 220, although feature 270 would be distinct, separable, and positioned proximate and/or below engagement feature 230. In all instances, feature 270 can be integrally formed or molded as part of shell 200.

An intermittent or continuous inward flange or catchment 272 is inclined toward the container neck 5. A circumferential protrusion 7, which may be formed as the lower-most portion of the neck 5, catches flange 272 so that elements 271 detach and annulus 270 remains positioned on the container neck 5 the first time the closure 100 is removed (or rotated sufficiently upward, in the axial direction). In this manner, the presence of detached annulus 270 serves as evidence in the event a user was attempting to tamper with the contents of the container.

In a further aspect, a cylindrical sealing flange 380 may be provided on the underside of panel 340 on the inner shell 300. In this manner, a receiving gap is formed between flange 380 and sidewall 320, with the size of the gap designed to engage and seal the neck 5 and, more specifically, neck finish 4. Finish 4 may be rounded or flat, but should create a fluidic seal along the entirety of the interface between closure 100 and container 5 and, more specifically, inner shell 300 and neck finish 4. The threads 3, 323 can be aligned so that the rotational movement of closure 100 further urges the container 5 into a sealing arrangement with shell 300. Additionally or alternatively, the range of motion encompassed by region 265 (i.e., the spacing between CR features 260, 360) may be similarly selected to cooperate with the plug seal formed by cylinder 380. Notably, the same effect may be attained by having the top panel 340 recessed to create space 370, as shown in the preceding drawings. In that same manner, top panel 340 in FIG. 7 could be afforded with a vent sealing capabilities.

In one aspect of the invention, closure may encompass any combination of the following features:

- an outer shell having an outer top panel, an outer cylindrical sidewall extending downward from the outer top panel, and a engagement groove disposed on an inner facing of the outer cylindrical sidewall;
- an inner shell nested within the outer shell and movable in an axial direction relative to the outer shell, said inner shell having an inner top panel, an inner skirt extending downward from the inner top panel, a radially protruding engagement feature disposed on an inner facing of the inner cylindrical sidewall and received and restrained within the engagement groove;
- wherein selectively interlocking child resistant features are formed on each of the outer shell and the inner shell along an interface therebetween;
- wherein downward movement of the outer shell urges the protruding engagement feature against an upper facing of the engagement groove so as to provide enhanced hoop strength to the closure in a radial direction;
- wherein a central portion of the inner top panel includes a fusing section forming a predetermined opening to release fluid or gas in response to pressure exerted on an inner facing of the inner top panel;
- a tamper evident feature having an inwardly inclined catchment, said tamper evident feature connected to a bottom edge of the outer cylindrical sidewall by at least one frangible element;

wherein a central portion of the inner top panel includes a venting section and wherein the interlocking child resistant features include an offset to allow release of fluid or gas when the venting section is ruptured or fused;

wherein the inner top panel is proximate to a lowermost edge of the sealing cylinder so as to impart a U-shaped cross section to the inner top panel;

wherein the inner top panel consists essentially of nylon, nylon 6/6, and/or nylon PA6;

wherein the interlocking child resistant features include cooperating ribs, lugs, and/or ratchet teeth;

wherein the inner skirt includes a shoulder section that engages at least one of a cooperating support formed on an inner facing of the outer shell and a sloping feature on a container neck, said shoulder section thereby imparting enhanced impact strength to the closure;

wherein an inner facing of the inner top panel includes an axially oriented sealing cylinder, said sealing cylinder spaced apart from the inner skirt to receive a finishing feature of a container neck edge;

wherein the inner top panel is recessed relative to the outer top panel so as to create sufficient clearance between the inner top panel and the outer top panel to accommodate venting of a central portion of the inner top panel; and wherein the outer cylindrical sidewall includes a plurality of support ribs on an outer facing of said sidewall.

All components should be made of materials having sufficient flexibility and structural integrity, as well as a chemically inert nature. The materials should also be selected for workability, cost, and weight. In addition to the materials specifically noted above, common polymers amenable to injection molding, extrusion, or other common forming processes should have particular utility, although metals, alloys, and other composites may be used in place of or in addition to more conventional container and closure materials.

References to coupling in this disclosure are to be understood as encompassing any of the conventional means used in this field. This may take the form of snap- or force fitting of components, although threaded connections, bead-and-groove, and slot-and-flange assemblies could be employed. Adhesive and fasteners could also be used, although such components must be judiciously selected so as to retain the underlying design goals inherent to the assembly.

In the same manner, engagement may involve coupling or an abutting relationship. These terms, as well as any implicit or explicit reference to coupling, will should be considered in the context in which it is used, and any perceived ambiguity can potentially be resolved by referring to the drawings.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A closure comprising:

an outer shell having an outer top panel, an outer cylindrical sidewall extending downward from the outer top panel, and a engagement groove disposed on an inner facing of the outer cylindrical sidewall;

an inner shell nested within the outer shell and movable in an axial direction relative to the outer shell, said inner shell having an inner top panel, an inner skirt extending downward from the inner top panel, a radially protruding engagement feature disposed on an inner facing of the inner cylindrical sidewall and received and restrained within the engagement groove;

wherein selectively interlocking child resistant features are formed on each of the outer shell and the inner shell along an interface therebetween;

wherein downward movement of the outer shell urges the protruding engagement feature against an upper facing of the engagement groove so as to provide enhanced hoop strength to the closure in a radial direction; and wherein the inner skirt includes a shoulder section that engages at least one of a cooperating support formed on an inner facing of the outer shell and a sloping feature on a container neck, said shoulder section thereby imparting enhanced impact strength to the closure.

2. The closure of claim 1 wherein a central portion of the inner top panel includes a fusing section forming a predetermined opening to release fluid or gas in response to pressure exerted on an inner facing of the inner top panel.

3. The closure of claim 1 further comprising a tamper evident feature having an inwardly inclined catchment, said tamper evident feature connected to a bottom edge of the outer cylindrical sidewall by at least one frangible element.

4. The closure of claim 1 wherein a central portion of the inner top panel includes a venting section and wherein the interlocking child resistant features include an offset to allow release of fluid or gas when the venting section is ruptured or fused.

5. The closure of claim 4 wherein the inner top panel consists essentially of nylon, nylon 6/6, and/or nylon PA6.

6. The closure of claim 1 wherein the interlocking child resistant features include cooperating ribs, lugs, and/or ratchet teeth.

7. The closure of claim 1 wherein the inner top panel is recessed relative to the outer top panel so as to create sufficient clearance between the inner top panel and the outer top panel to accommodate venting of a central portion of the inner top panel.

8. The closure of claim 1 wherein the outer cylindrical sidewall includes a plurality of support ribs on an outer facing of said sidewall.

9. The closure of claim 1 wherein an inner facing of the inner top panel includes an axially oriented sealing cylinder, said sealing cylinder spaced apart from the inner skirt to receive a finishing feature of a container neck edge.

10. The closure of claim 1 further comprising a cylindrical sealing flange extending downward from the inner top panel to define a gap between the cylindrical sealing flange and the inner skirt and wherein the gap is configured to receive and seal to a finishing feature of a container neck edge.

11. A closure comprising:

an outer shell having an outer top panel, an outer cylindrical sidewall extending downward from the outer top panel, and a engagement groove disposed on an inner facing of the outer cylindrical sidewall;

an inner shell nested within the outer shell and movable in an axial direction relative to the outer shell, said inner shell having an inner top panel, an inner skirt extending downward from the inner top panel, a radially protruding engagement feature disposed on an inner facing of the inner cylindrical sidewall and received and restrained within the engagement groove;

wherein selectively interlocking child resistant features are formed on each of the outer shell and the inner shell along an interface therebetween;

wherein downward movement of the outer shell urges the protruding engagement feature against an upper facing of the engagement groove so as to provide enhanced hoop strength to the closure in a radial direction; and wherein an inner facing of the inner top panel includes an axially oriented sealing cylinder, said sealing cylinder spaced apart from the inner skirt to receive a finishing feature of a container neck edge.

12. The closure of claim 11 wherein a central portion of the inner top panel includes a venting section and wherein the interlocking child resistant features include an offset to allow release of fluid or gas when the venting section is ruptured or fused.

13. The closure of claim 11 wherein the inner top panel is proximate to a lowermost edge of the sealing cylinder so as to impart a U-shaped cross section to the inner top panel.

14. The closure of claim 13 wherein a central portion of the inner top panel includes a venting section and wherein the interlocking child resistant features include an offset to allow release of fluid or gas when the venting section is ruptured or fused.

15. The closure of claim 11 wherein the inner top panel is recessed relative to the outer top panel so as to create sufficient clearance between the inner top panel and the outer top panel to accommodate venting of a central portion of the inner top panel.

16. The closure of claim 11 wherein the outer cylindrical sidewall includes a plurality of support ribs on an outer facing of said sidewall.

17. The closure of claim 11 wherein an inner facing of the inner top panel includes an axially oriented sealing cylinder, said sealing cylinder spaced apart from the inner skirt to receive a finishing feature of a container neck edge.

18. The closure of claim 11 further comprising a cylindrical sealing flange extending downward from the inner top panel to define a gap between the cylindrical sealing flange and the inner skirt and wherein the gap is configured to receive and seal to a finishing feature of a container neck edge.

19. The closure of claim 11 wherein a central portion of the inner top panel includes a fusing section forming a predetermined opening to release fluid or gas in response to pressure exerted on an inner facing of the inner top panel.

20. The closure of claim 11 further comprising a tamper evident feature having an inwardly inclined catchment, said tamper evident feature connected to a bottom edge of the outer cylindrical sidewall by at least one frangible element.

21. The closure of claim 11 wherein the interlocking child resistant features include cooperating ribs, lugs, and/or ratchet teeth.

* * * * *